United States Patent [19]

Av-Zuk

[11] Patent Number: 4,685,258

[45] Date of Patent: Aug. 11, 1987

[54] ACCESS FLOORING SYSTEM WITH INCREASED LOAD CAPACITY

[75] Inventor: Joseph Av-Zuk, Holon, Israel

[73] Assignee: Alcol, Ltd., Holon, Israel

[21] Appl. No.: 804,295

[22] Filed: Dec. 3, 1985

[30] Foreign Application Priority Data

Dec. 5, 1984 [IL] Israel ..... 73748

[51] Int. Cl.[4] ..... E04D 15/00

[52] U.S. Cl. ..... 52/126.6; 52/299; 52/648

[58] Field of Search ..... 52/126.5, 126.6, 263, 52/7, 650, 665, 299, 693, 648, 655, 81

[56] References Cited

U.S. PATENT DOCUMENTS 3,688,461 9/1972 Rensch ..... 52/263 X 4,277,923 7/1981 Rebentisch et al. ..... 52/126.6

FOREIGN PATENT DOCUMENTS 2065259 5/1973 Fed. Rep. of Germany ..... 52/263

2260666 10/1975 France ..... 52/299

*Primary Examiner*—Carl D. Friedman

*Assistant Examiner*—Naoko N. Slack

*Attorney, Agent, or Firm*—Natter & Natter

[57] ABSTRACT

An access flooring system includes a plurality of adjustable height pedestals which support a skeletal grid of stringers. The stringers, in turn, support a plurality of rectangular floor panels. Each pedestal includes a head for supporting not only stringers which are registered with perpendicular edges of floor panels, but, in addition, stringers which extend diagonally. The diagonal stringers provide increased load capacity for the system and resist medial deflections of the panels.

11 Claims, 8 Drawing Figures

ACCESS FLOORING SYSTEM WITH INCREASED LOAD CAPACITY

FIELD OF THE INVENTION

This invention relates generally to access flooring systems and more particularly to a system having a grid substructure including stringers.

BACKGROUND ART

Access flooring systems were originally employed in computer systems and have, over the years, found diversified applications in differing fields such as office environments laboratories, communication facilities, hospitals, clean rooms and other instances wherein the advantages of creating and utilizing a space between a load supporting flooring and a structural subflooring became evident. Access flooring systems have been utilized to conceal electrical wiring, telephone cables, computer communications cable networks, air conditioning duct work, plumbing lines, fire and smoke detection systems and other systems, yet permitted access for maintenance, additions and alterations.

Basic access flooring systems included rectangular floor panels of metal which were reinforced or, metal covered composition wood cores. The floor panels were supported at an elevation above the subfloor by spaced pedestals which were capable of height adjustment. In gridless systems, the pedestal heads were positioned beneath the corners of four abutting panels so that each panel was supported by a pedestal at one of its corners.

In instances wherein increased stability and load capacity were required, the pedestals included heads to which horizontally oriented perpendicular stringers were attached. The grid was formed so that each stringer was registered with and positioned beneath an edge of a rectangular panel. The grid system thus provided additional support for each panel along its entire periphery. Some access flooring systems such as illustrated in U.S. Pat. No. 3,396,501 additionally included provisions for clamping devices to secure stringers to the pedestal heads to prevent displacement.

SUMMARY OF THE INVENTION

In compendium, the invention comprises an access flooring system which employs a substructure formed of a plurality of pedestals spaced to support abutting rectangular floor panels at their corners. Panel edge stringers are anchored at their ends to the pedestals in a rectangular grid pattern and support the panels along their peripheries.

Each pedestal is provided with arms for supporting the panel edge stringers. In addition, each pedestal includes support arms for attachment of up to four additional diagonal stringers which extend the grid in diagonal directions for midpanel load support.

The pedestals include a cylindrical tube which seats over and is adjustable relative to a threaded post projecting vertically from a pedestal base. The pedestal also includes a head seated over the top of the tube; the stringer support arms project from the head. For stringer securement, selected support arms interlock with the ends of stringers.

In instances wherein diagonal stringers cross one another, one of the stringers is bifurcated with an intermediate space to accommodate the perpendicular diagonal stringer. The bifurcated stringer is supported by a brace from beneath.

From the foreoing summary, it will be appreciated that it is a consideration of the present invention to provide an access flooring system of the general character described having increased load capacity and which is not subject to the disadvantages of the background art aforementioned.

An additional feature of the present invention is to provide an access flooring system of the general character described which includes a substructure capable of increasing the load capacity of floor panels.

A further aspect of the present invention is to provide an access flooring system of the general character described having a plurality of substructure pedestals which support stringers extending diagonally beneath rectangular floor panels.

A further consideration of the present invention is to provide an access flooring system of the general character described having high lateral stability with increased load capacity.

Yet another aspect of the present invention is to provide an access flooring system of the general character described which is relatively low in cost and capable of economic mass production fabrication.

Another feature of the present invention is to provide an access flooring system of the general character described having increased load capacity and which is relatively simple to install by unskilled labor.

Other aspects, features and considerations of the invention in part will be obvious and in part will be pointed out hereinafter.

With these ends in view, the invention finds embodiment certain combinations of elements, arrangement of parts, and series of steps by which the said aspects, features and considerations and certain other considerations are attained, all with reference to the accompanying drawings and the scope of which is more particularly pointed out and indicated in the appended claims.

In the accompanying drawings in which is shown one of the various possible exemplary embodiments of the invention:

DESCRIPTION OF THE PREFERRED EMBODIMENT

Figure 1:
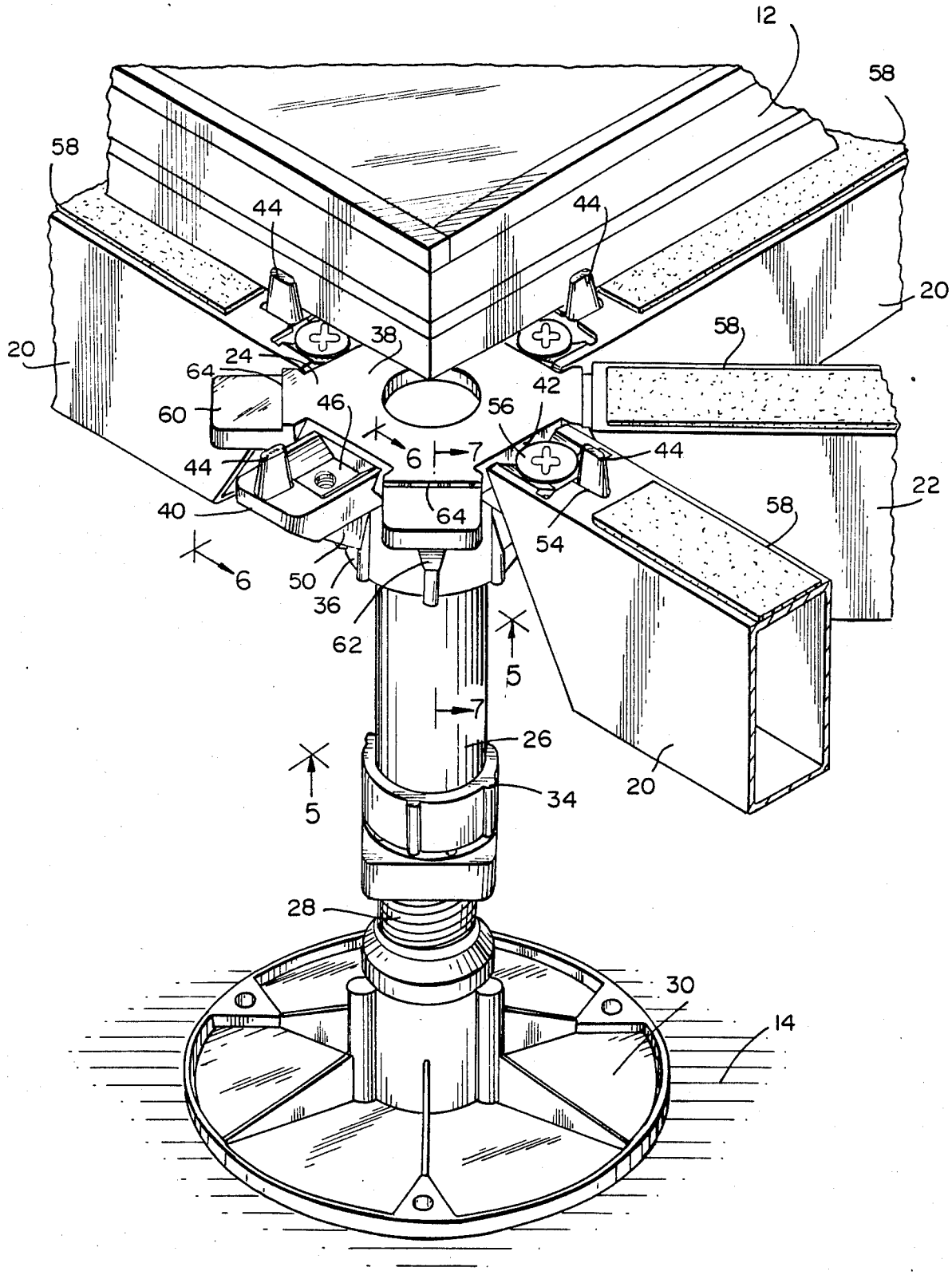
FIG. 1 is a fragmentary perspective illustration of a typical access flooring system constructed in accordance with and embodying the invention and showing a support pedestal to which are mounted a plurality of stringers which carry floor panels and with selected panels and stringers deleted for the purpose of more clearly illustrating the invention.

Referring now in detail to the drawings, the reference numeral 10 denotes generally an access flooring system constructed in accordance with and embodying the invention. The system comprises a plurality of rectangular floor panels 12 supported above a subflooring 14 by a skeletal grid 16 (FIG.2) of adjustable height pedestals 18 and tubular metal stringers. The grid 16 includes a rectangular array of panel edge stringers 20 adapted to support the floor panels 12 along the length of each panel edge. The ends of the panel edge stringers are supported from the pedestals 18.

Pursuant to the invention, a further array of diagonal stringers 22 is provided to furnish additional medial support for the floor panels 12 thus increasing their load bearing capacity without requiring substitution of strengthened floor panels. Each pedestal 18 includes a cast metal head 24 which is mounted over an upright cylindrical tube 26. The tube 26 is seated over a threaded post 28 which projects upwardly from a base 30. The height of the head 24 relative to the subflooring 14 is adjusted by rotating a nut 32 on the stem 28 which is locked in position by a nonrotatable collar 34 fixed to the bottom of the tube 26.

The upper end of the tube 26 is anchored within a socket 36 projecting downwardly from the head 24. The top of the head 24 includes a generally planar platen 38 against which the corners of the floor panels 12 rest. Projecting radially from the platen 38 are four anchor support arms 40 with each arm 40 being perpendicular to the adjacent arm 40. The anchor support arms 40 are adapted to support the panel edge stringers 20 and include an upper surface having an elevation lower than that of the platen 38. The arms 40 are interconnected with the platen at a shoulder 42.

An upstanding lug 44 projects upwardly from the tip of the support arm 40 along its center. The lugs 44 align a corner undersurface of a floor panel 12 adjacent the platen 38 and retain and align panel edge stringers 20 to the arm 40. Referring again to FIG. 1 it will be seen that a floor panel 12 is positioned so that it is supported on its undersurface adjacent each corner by a portion of the platen 38. Such positioning is facilitated by merely moving a floor panel 12 toward a pedestal 18 until two intersecting side edges of the floor panel 12 abut the respective lugs 44 of two adjacent support arms 40. Contiguous floor panels 12 will be positioned adjacent to one another in abutting relationship along their upper surfaces because the sides of each floor panel are downwardly tapered to accommodate the lugs 44.

Figure 6:
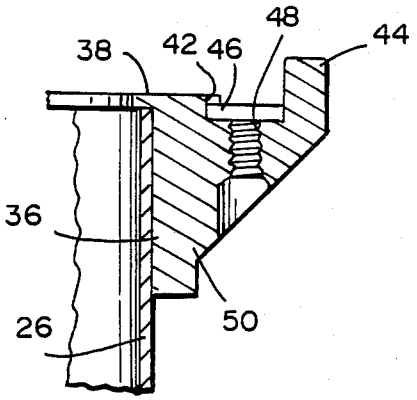
FIG. 6 is a fragmentary sectional view through an anchoring support arm of the pedestal head and the pedestal tube, the same being taken substantially along the plane 6—6 of FIG. 1.
Figure 7:
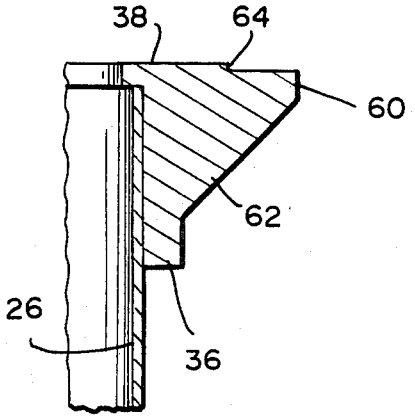
FIG. 7 is a fragmentary sectional view through a diagonal stringer support arm of the head and a portion of the pedestal tube, the same being taken substantially along the plane 7—7 of FIG. 1.

The upper surface of each support arm 40 additionally includes a retaining well 46 having sloped side edges and a threaded central aperture 48. As will be observed from FIG. 6, the aperture 48 extends through a reinforcing gusset web 50 which projects from the arm 40 of the socket 36.

Figure 8:
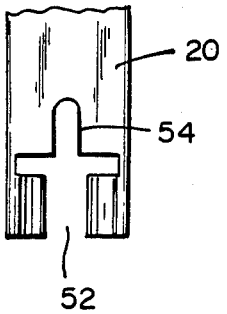
FIG. 8 is a fragmentary plan view of an end portion of a stringer adapted for securement to an anchor support arm of the pedestal.

Referring now to FIGS. 1 and 8, it will be seen that a panel edge stringer 20 includes a conformingly configured upper surface to be matingly engaged on the support arm 40. It will be noted that the upper surface of the stringer 20 includes a relatively wide longitudinal opening 52 extending a distance inwardly from its distal edge. In addition, portions of the upper surface are downwardly inturned facing the opening 52 at an angle which mates with the sloped walls of the retaining well 46. Further, a reduced width space 54 extends beyond the opening 52 and is dimensioned to permit a lug 44 to project therethrough as illustrated in FIG. 1.

It should also be noted that a flat head bolt 56 is threadingly seated within each aperture 48. When a stringer 20 is engaged in the well 46, the bolt 56 is tightened to anchor the stringer and provide a rigid interlocking skeletal frame. The bolts 56 need not be removed to permit the sloped walls of the stringer opening 52 to be inserted into the retaining well 46 but need only be loosened. The sides of the stringer 20 overlie the sides of the arm 40 for additional lateral rigidity. The thickness of the upper surface of a stringer 20 plus that of an overlying cushion strip 58 is such that the surface supporting the underside of the edges of the panels will be the same height as the platen 38.

Pursuant to the invention, the pedestal head 24 additionally includes four equidistantly spaced diagonal stringer support arms 60. The arms 60 project radially from the platen 38 along axes which bisect the perpendicular angle formed at the vertices of adjacent anchor support arms 40. Each diagonal support arm 60 is reinforced by a gusset web 62 extending from the underside of the support arm to the socket 36.

It should also be noted that a step 64 is provided between the upper surface of the support arm 60 and the platen 38. As will be observed from FIG. 1, when a diagonal stringer 22 is supported by a support arm 60, the thickness of the upper surface of the diagonal support arm combined with its cushion strip 58 mates with the elevation of the platen 38 to provide an equal elevation support for the entire undersurface of a floor panel 12.

Figure 2:
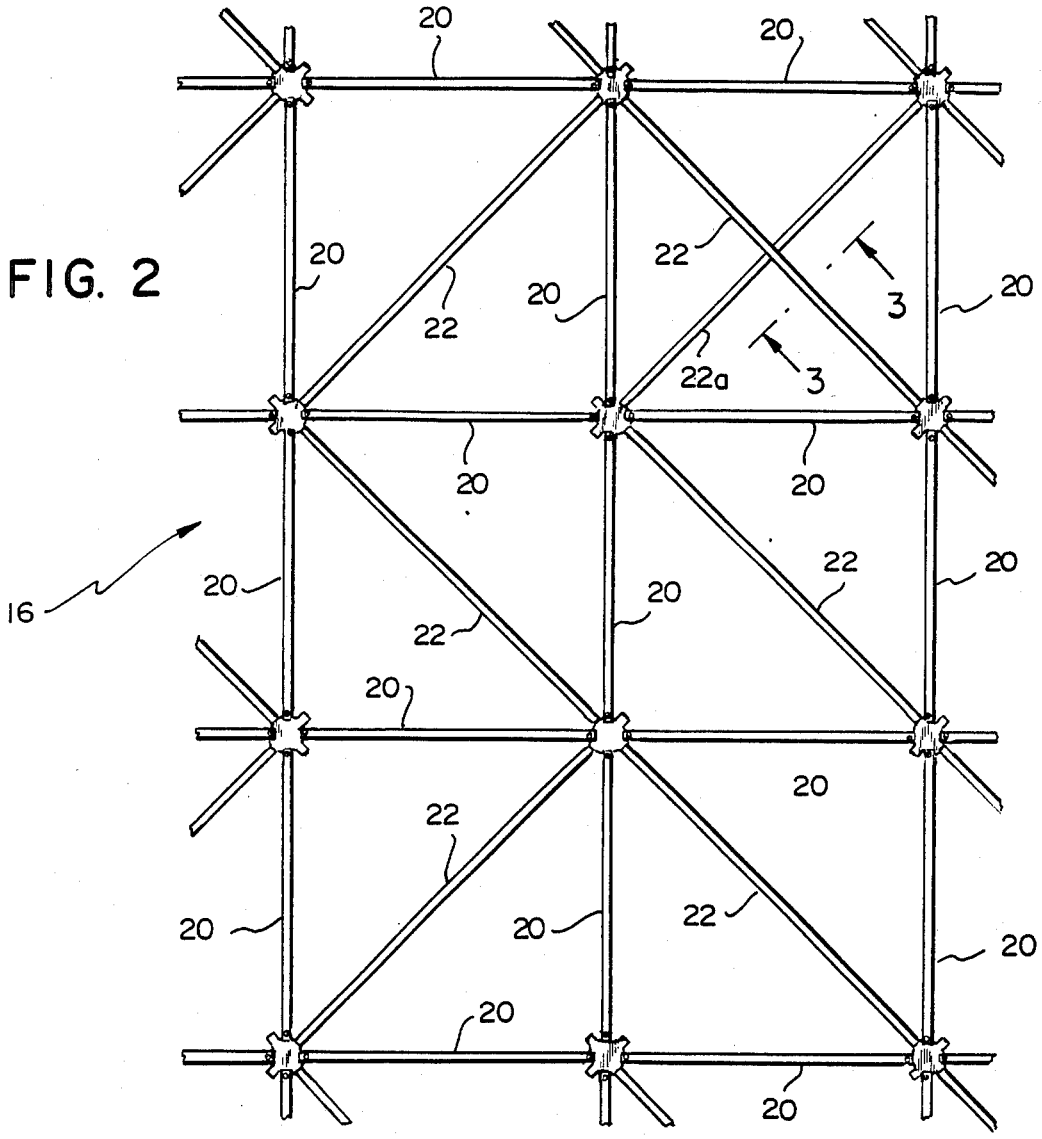
FIG. 2 is a reduced scale plan view of an access flooring skeletal grid constructed in accordance with the invention and showing interconnected stringers and pedestals for supporting floor panels.
Figure 3:
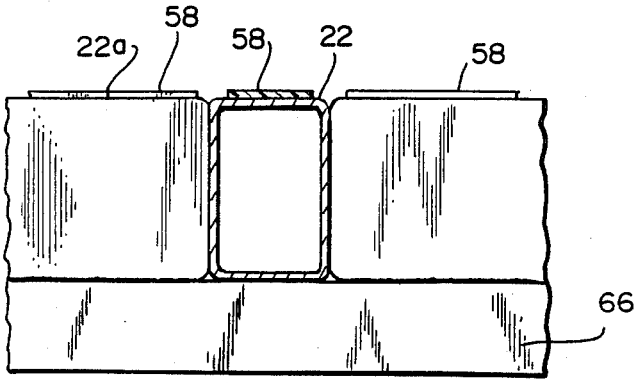
FIG. 3 is an enlarged scale sectional view of two intersecting diagonal stringers, the same being taken substantially along the line 3—3 of FIG. 2.
Figure 4:
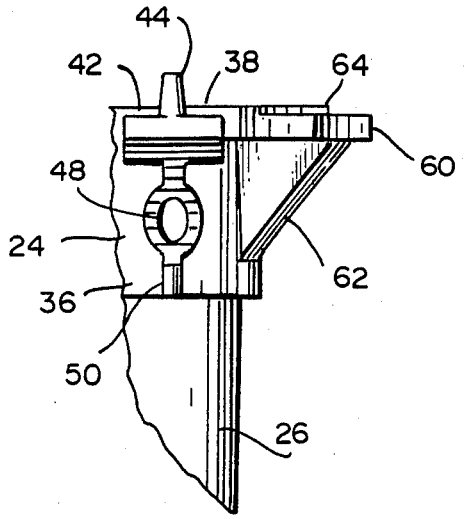
FIG. 4 is a fragmentary elevational view of an upper portion of a pedestal and showing a pedestal tube and a pedestal head having a plurality of stringer support arms.
Figure 5:
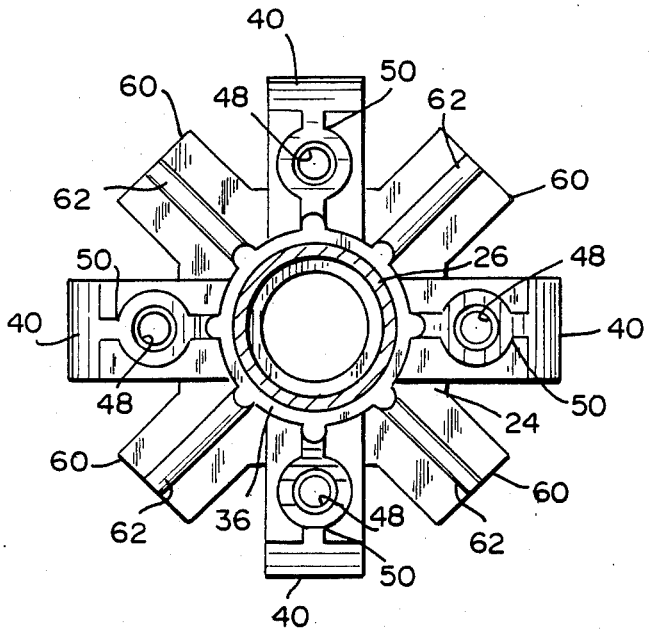
FIG. 5 is a sectional view through the pedestal tube the same being taken substantially along the plane of 5—5 of FIG. 1 and showing the underside of the head, with stringers and floor panels deleted.

In the plan view of FIG. 2, a typical skeletal support grid including diagonal stringers 28 in accordance with this invention is illustrated. It should be appreciated that the diagonal stringers 22 need only be employed in areas where increased load is to be encountered. Further, in particular areas of excessive loads, selected diagonal stringers 22 may be employed with crossing stringers **22*a* as illustrated in the upper right hand portion of the grid shown in FIG. 2. In such instance, the crossing diagonal stringer 22*a* is bifurcated to accommodate the stringer 22. A suitable metal plate 66 joins the bifurcated portions of the stringer 22*a* along the undersurface and may be welded or otherwise secured to the segments bifurcated stringer 22*a***.

It should also be appreciated that the engagement between the anchor support arms 40 and the panel edge stringers 20 is of a locking nature and provides significant lateral stability to the subfloor system. In instances wherein excessive lateral stresses may be encountered, the support arms for the diagonal stringers 22 may also be configured with retaining wells and panel edge stringer ends may be utilized with diagonal stringers. It should be understood, however, that the lugs 44 which project upwardly will not be provided on the modified diagonal stringer support arms.

Thus it will be seen that there is provided an access flooring system with increased load capacity which achieves the various features, aspects and consideration of the invention and which is well suited to meet the condition of practical usage.

Since various possible embodiments might be made of the access flooring system herein described and various changes might be made in the exemplary embodiment set forth, it is to be understood that all matters shown or described in the accompanied drawings are to be interpreted as illustrative and not in a limiting sense.

Having thus described the invention there is claimed as new and desired to be secured by letters patent:

1. In an access flooring system comprising a skeletal grid of horizontal floor panel edge supporting stringers arranged in a plurality of horizontal rectangles and a plurality of pedestal means for supporting the panel edge supporting stringers adjacent the ends of each of the edge supporting stringers at the corners of each rectangle and for supporting the corners of floor panels, the improvement comprising at least one additional horizontal stringer extending diagonally across a selected rectangle formed of four edge supporting stringers and at least two pedestal means including means for supporting the additional stringer adjacent the ends of the additional stringer, the two pedestal means being positioned at diagonal corners of the selected rectangle, the additional stringer including means for medially supporting a floor panel positioned over the selected rectangle, whereby the access flooring system maintains an increased load bearing capacity.

2. An improvement in an access flooring system constructed in accordance with claim 1 wherein the means for supporting the additional stringer comprises a support arm projecting from each of the two pedestal means, the additional stringer comprising a channel having a substantially flat load bearing surface and a pair of substantially parallel sides, the sides straddling the support arm and the channel load bearing surface resting on the support arm.

3. An improvement in an access flooring system constructed in accordance with claim 1 further including a plurality of additional horizontal stringers, each additional horizontal stringer extending diagonally across a further rectangle formed of four edge supporting stringers and being supported adjacent its ends by two pedestal means positioned at diagonal corners of the further rectangle.

4. An improvement in an access flooring system constructed in accordance with claim 1 the system further including a plurality of substantially rectangular floor panels, each of the floor panels including side edges, and each of the floor panel side edges being positioned over an edge supporting stringer, the underside of one floor panel being positioned over the additional stringer, whereby the one floor panel is medially supported for increased load capacity.

5. An improvement in an access floor system constructed in accordance with claim 1 wherein the additional horizontal stringer joins two nonadjacent vertices, the grid including a further horizontal stringer, the further horizontal stringer joining the remaining nonadjacent vertices of the selected rectangle, the further horizontal stringer intersecting the additional horizontal stringer and being bifurcated into segments at the intersection with the additional stringer, and structural reinforcing means for securing the bifurcated segments of the further stringer.

6. A pedestal for an access flooring system adapted for increased load capacity, the pedestal comprising base means for engagement with a subfloor support surface, a head, means interconnecting the base and the head for supporting the head at an elevation above the subfloor surface, the head including means for supporting one stringer, means for supporting a further stringer at a right angle relative to the one stringer, the one stringer and the further stringer lying in a plane, and means for supporting an additional stringer at an acute angle relative to both stringers and in substantially the same plane.

7. A pedestal for an access flooring system constructed in accordance with claim 6, wherein the head includes means for supporting a fourth stringer at a right angle relative to the further stringer.

8. A pedestal for an access flooring system constructed in accordance with claim 7, wherein the head includes means for supporting a fifth stringer at a right angle relative to the fourth stringer.

9. A pedestal for an access flooring system constructed in accordance with claim 8, wherein the head further includes means for supporting a sixth stringer at a right angle relative to the additional stringer.

10. A pedestal for an access flooring system constructed in accordance with claim 6, wherein the means for supporting the stringers includes support arms projecting from the head, each stringer having a load bearing surface adapted to be positioned over one of the arms.

11. A pedestal for an access flooring system constructed in accordance with claim 10, wherein each stringer includes a pair of spaced sides extending downwardly from the upper surface, the sides of each support arm being positionable between the sides of a stringer.

* * * * *